US011708757B1

(12) United States Patent
Montgomery

(10) Patent No.: US 11,708,757 B1
(45) Date of Patent: Jul. 25, 2023

(54) METHOD AND APPARATUS FOR TESTING SETTING TOOLS AND OTHER ASSEMBLIES USED TO SET DOWNHOLE PLUGS AND OTHER OBJECTS IN WELLBORES

(71) Applicant: FORTRESS DOWNHOLE TOOLS, L.L.C., Broussard, LA (US)

(72) Inventor: M. Joseph Montgomery, Lafayette, LA (US)

(73) Assignee: FORTRESS DOWNHOLE TOOLS, LLC, Broussard, LA (US)

( * ) Notice: Subject to any disclaimer, the term of this patent is extended or adjusted under 35 U.S.C. 154(b) by 0 days.

(21) Appl. No.: 17/481,835

(22) Filed: Sep. 22, 2021

Related U.S. Application Data

(63) Continuation-in-part of application No. 15/930,928, filed on May 13, 2020, now Pat. No. 11,280,143.

(60) Provisional application No. 62/847,639, filed on May 14, 2019.

(51) Int. Cl.
*E21B 23/04* (2006.01)
*E21B 47/117* (2012.01)
*E21B 47/06* (2012.01)

(52) U.S. Cl.
CPC ..... *E21B 47/117* (2020.05); *E21B 47/06* (2013.01)

(58) Field of Classification Search
CPC ..... E21B 47/117; E21B 23/06; E21B 23/065; E21B 23/04; F16L 2201/30; G01M 13/005
See application file for complete search history.

(56) References Cited

U.S. PATENT DOCUMENTS

RE25,846 E * 8/1965 Campbell ..... E21B 33/1295 166/122
6,435,775 B1 * 8/2002 Nish ..... F16L 1/24 405/195.1
2004/0045724 A1 * 3/2004 Buyers ..... E21B 23/06 166/135
2004/0174015 A1 * 9/2004 Deremiah ..... F16L 21/035 285/230
2005/0109082 A1 * 5/2005 Stewart ..... G01M 3/26 73/40
2007/0108201 A1 * 5/2007 Vinegar ..... E21B 43/2401 219/770
2008/0099704 A1 * 5/2008 Lauber ..... B67D 7/3218 251/73
2008/0230235 A1 * 9/2008 Loughlin ..... E21B 33/1285 166/387

(Continued)

*Primary Examiner* — Kipp C Wallace
(74) *Attorney, Agent, or Firm* — Ted M. Anthony

(57) ABSTRACT

A wireline conveyed, gas driven setting tool configured to set downhole tools including, without limitation, frac plugs, bridge plugs, cement retainers and packers. The setting tool is functioned by selectively igniting a power charge inside of a firing head. As the power charge burns, it generates gas that acts upon a piston area to stroke the setting tool. A dampening media, as well an optimized flow area at or near the distal end of the setting tool, act to slow the setting stroke. A mobile testing assembly can confirm that a setting tool or other associated equipment was manufactured and assembled properly, and is fit for service, prior to running the setting tool a well bore. The mobile testing assembly and testing method can be employed in a shop or other manufacturing facility, or on a well site or other remote location.

20 Claims, 11 Drawing Sheets

(56) References Cited

U.S. PATENT DOCUMENTS

| | | | | |
|---|---|---|---|---|
| 2008/0296025 | A1* | 12/2008 | Inderberg | E21B 47/117 166/337 |
| 2010/0289225 | A1* | 11/2010 | Lafleur | E21B 17/02 285/119 |
| 2012/0205123 | A1* | 8/2012 | Kennedy | E21B 33/04 166/208 |
| 2012/0318527 | A1* | 12/2012 | Erkol | E21B 34/06 166/325 |
| 2014/0196912 | A1* | 7/2014 | Turley | E21B 43/10 166/85.1 |
| 2015/0247377 | A1* | 9/2015 | Williamson, Jr. | E21B 23/04 166/154 |
| 2015/0330890 | A1* | 11/2015 | Clevelario | F16L 17/02 285/96 |
| 2018/0038763 | A1* | 2/2018 | Tuttle | G01M 3/04 |
| 2022/0106949 | A1* | 4/2022 | Takahashi | F04B 49/06 |

* cited by examiner

METHOD AND APPARATUS FOR TESTING SETTING TOOLS AND OTHER ASSEMBLIES USED TO SET DOWNHOLE PLUGS AND OTHER OBJECTS IN WELLBORES

BACKGROUND OF THE INVENTION

1. Field of the Invention

The present invention pertains to a setting tool that can be used to set plugs and other downhole equipment within wellbores. More particularly, the present invention pertains to a compact and cost-efficient setting tool that can be conveyed via wireline for setting downhole tools and other equipment with wellbores. More particularly still, the present invention pertains to a method and apparatus for testing the operational integrity of a setting tool before running into a well.

2. Brief Description of the Prior Art

Wells are typically drilled into the earth's crust using a drilling rig or other similar equipment. After a section of wellbore has been drilled to a desired depth, a string of pipe known as casing is typically conveyed into said well and cemented in place. The casing is often installed to provide structural integrity to the wellbore and to keep geologic formations isolated from one another.

In some applications, a wireline tool string may be run into the wellbore after the casing has been installed in a well. Although many different configurations are possible, the wireline tool string may include a downhole plug that may be set within the inner bore of the casing string at a desired location in the wellbore, as well as a setting tool for setting said downhole plug. Generally, such a plug is used to isolate one portion of a wellbore from another. Although this operation is commonly used in many different operations, such wellbore plugs are commonly used in connection with hydraulic fracturing operations.

Conventional downhole wireline setting tools (for example, a "Baker 20") are long, complex, and require multiple personnel to handle. Thus, it would be beneficial to have a downhole wireline setting tool that is shorter and lighter than conventional setting tools. Further, the setting tool should beneficially have less components, be capable of being redressed and reused more quickly, and be easier to operate than conventional wireline setting tools.

SUMMARY OF THE INVENTION

The present invention comprises a wireline conveyed, gas driven setting tool designed to set downhole tools, such as fracturing ("frac") plugs, zone isolation plugs, bridge plugs, cement retainers, and packers. The setting tool of the present invention is functioned by igniting a power charge inside a firing head. As said power charge burns, the combustion generates gas that acts upon a piston area to stroke setting components of the apparatus.

The setting tool of the present invention generally comprises pressure sub, upper sleeve member, lower sleeve member, central tension mandrel, and tension mandrel adapter. In a preferred embodiment, the central longitudinal axes of each of said pressure sub, upper sleeve member, lower sleeve member and central tension mandrel are all oriented substantially parallel to each other. The lower sleeve member is secured to upper sleeve member which, in turn, is secured against movement along the length of central tension mandrel using at least one shear screw (or pin).

The setting tool is functioned by selectively igniting a power charge inside of a pressure chamber formed within said pressure sub. As the power charge burns, it generates gas that acts upon a piston area to shear said shear screw(s) and stroke the setting tool. A dampening media, as well an optimized flow area at or near the distal end of the setting tool, act to slow or regulate the setting stroke. When stroked, said upper sleeve member and lower sleeve member are displaced along the longitudinal axis of said tension mandrel, thereby causing an attached downhole plug or other object to be set according to a process understood by those in the art that, for clarity and conciseness, is not described in detail in this disclosure.

The setting tool of the present invention is shorter and lighter than conventional setting tools. Further, the setting tool of the present invention has less components, can be redressed in a fraction of the time compared to conventional setting tools, and can be efficiently operated by a single person. Unlike many conventional setting tools, the setting tool of the present invention does not require oil to dampen setting force. As a result, the setting tool of the present invention requires less parts and seal areas (potential leak paths), while eliminating risk for human error (that is, forgetting the oil entirely or loading the incorrect volume of oil).

The setting tool of the present invention utilizes a dampening assembly within said setting tool to slow the setting stroke of the tool; such dampening effect is frequently beneficial when setting tools and other equipment downhole within a wellbore. Additionally, an optimized flow area at or near the bottom or distal end of the setting tool also acts to slow said setting stroke.

The present invention further comprises a method and apparatus for testing the operational integrity and sealing quality of fluid (that is, liquid or gas) pressure seals disposed within setting tools including, without limitation, the setting tool assembly of the present invention disclosed herein. By way of illustration, but not limitation, the method and apparatus of the present invention can be used to test a setting tool (as well as any associated equipment attached thereto, such as a downhole plug) prior to being run in a wellbore and used in a downhole environment. Further, such testing can be performed at a remote location (such as a manufacturing plant, fabrication shop or other facility) prior to transportation of the equipment to a well site, and/or at a well site prior to running into a well with said equipment. By confirming that said internal seals of a setting tool are functioning properly prior to running into a well with said setting, the testing method and apparatus of the present invention can greatly reduce the risk of a costly downhole operational failure caused by leaking internal seals. Moreover, in the event that an inadvertent tool failure does occur, the method and apparatus of the present invention can provide valuable evidence that said internal seals did not cause said failure.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT OF THE INVENTION

While the present invention will be described with reference to preferred embodiments, it will be understood by those skilled in the art that various changes may be made and equivalents may be substituted for elements thereof without departing from the scope of the present invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting. As used herein, the term "sub" is intended to generically refer to a section or a portion of a tool string. While a sub may be modular and use threaded connections, no particular configuration is intended or implied by the use of the term sub.

Figure 1:
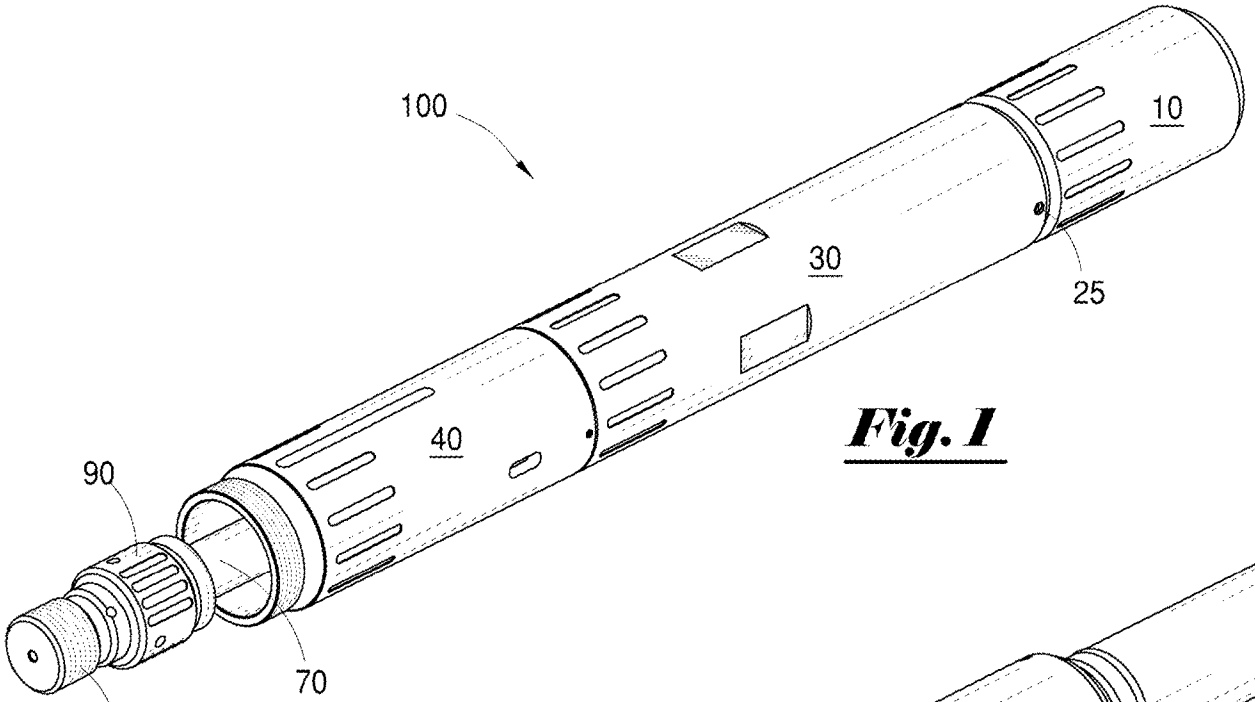
FIG. 1 depicts a side perspective view of the setting tool apparatus of the present invention in a retracted or "un-stroked" configuration.

FIG. 1 depicts a side perspective view of setting tool apparatus 100 of the present invention in a retracted or "un-stroked" configuration. As depicted in FIG. 1, said setting tool apparatus 100 generally comprises pressure sub 10, upper sleeve member 30, lower sleeve member 40, central tension mandrel 70 and tension mandrel adapter 90. In a preferred embodiment, the central longitudinal axes of each of said pressure sub 10, upper sleeve member 30, lower sleeve member 40 and central tension mandrel 70 are all oriented substantially parallel to each other. In the configuration depicted in FIG. 1, lower sleeve member 40 is secured to upper sleeve member 30 which, in turn, is secured against movement along the length of central tension mandrel 70 using at least one shear screw (or pin) 25.

Figure 2:
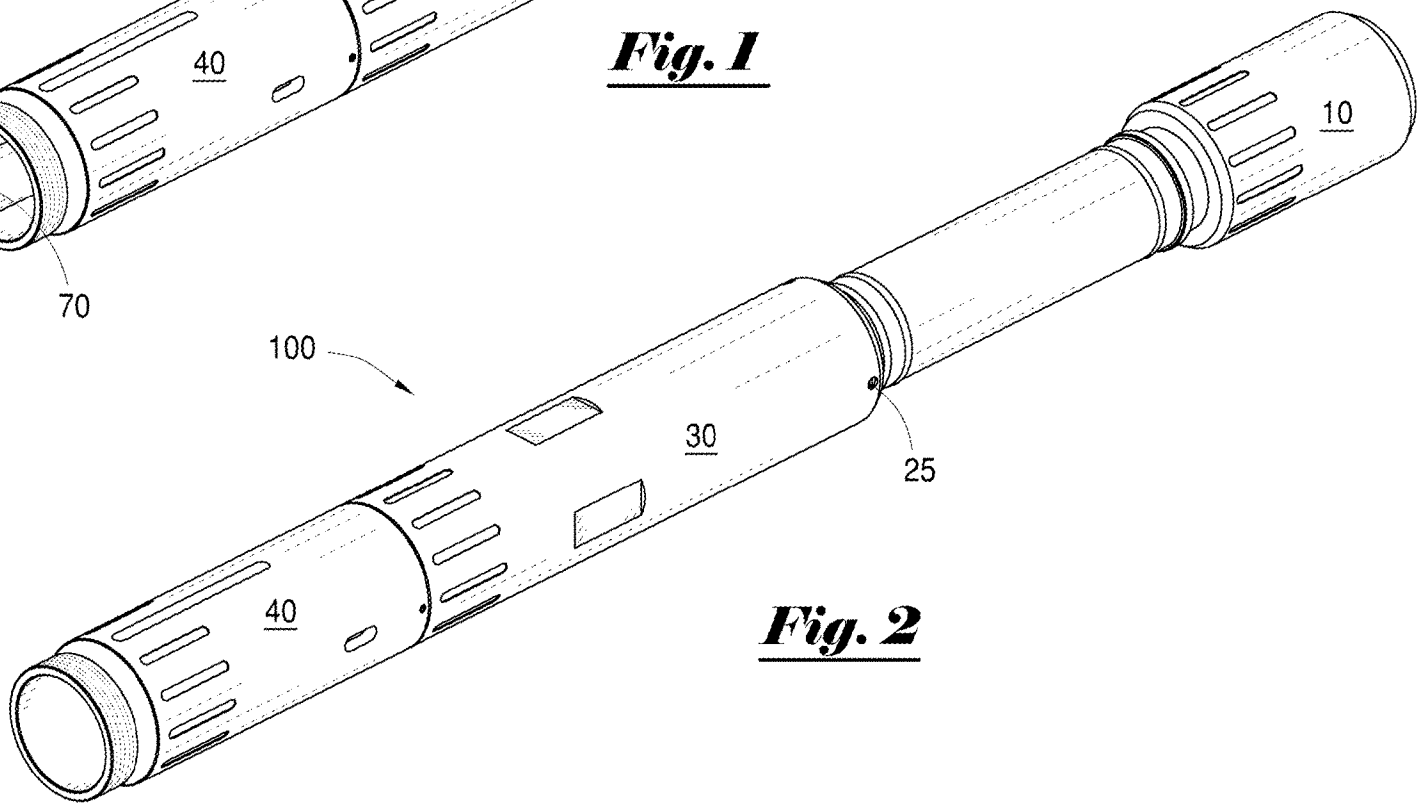
FIG. 2 depicts a side perspective view of the setting tool apparatus of the present invention in an extended or "stroked" configuration.

FIG. 2 depicts a side perspective view of setting tool apparatus 100 of the present invention in an extended or "stroked" configuration. As depicted in FIG. 2, said at least one shear screw 25 has been sheared. As a result, upper sleeve member 30 and attached lower sleeve member 40 are capable of movement along the length of central tension mandrel 70. In the configuration depicted in FIG. 2, said upper sleeve member 30 and lower sleeve member 40 are displaced along the longitudinal axis of said tension mandrel 70, thereby exposing at least a portion of body section 13 of pressure sub 10.

Figure 3:
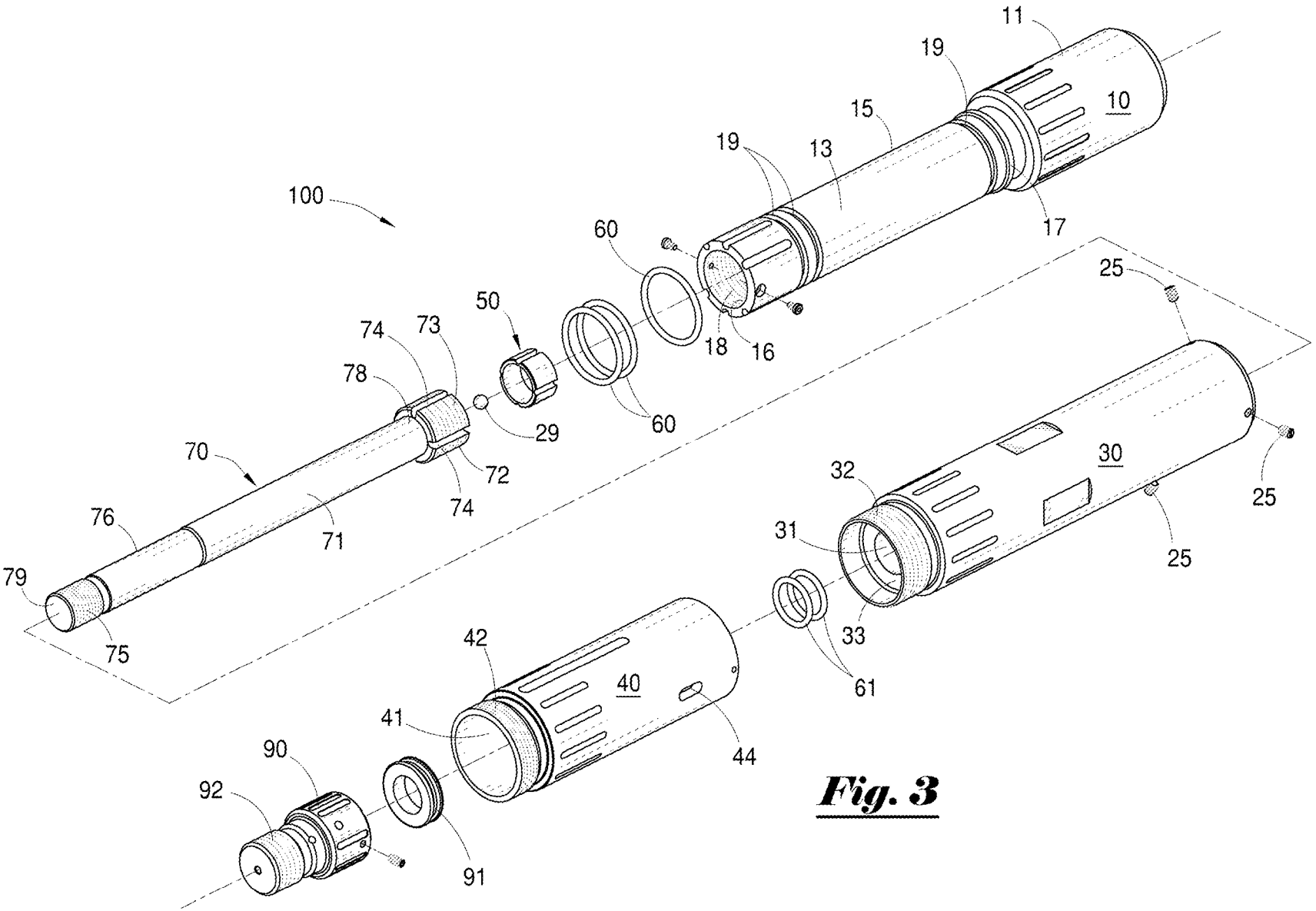
FIG. 3 depicts a side perspective and exploded view of the setting tool apparatus of the present invention.

FIG. 3 depicts a side perspective and exploded view of setting tool apparatus 100 of the present invention. Setting tool apparatus 100 generally comprises pressure sub 10, upper sleeve member 30, lower sleeve member 40, central tension mandrel 70 and tension mandrel adapter 90. In a preferred embodiment, the central longitudinal axes of each of said pressure sub 10, upper sleeve member 30, lower sleeve member 40, central tension mandrel 70 and tension mandrel adapter 90 are all oriented substantially parallel to each other.

Pressure sub 10 generally comprises upper connection member 11 and body section 13. In a preferred embodiment, said upper threaded connection member 11 comprises a female or "box-end" threaded connection having internal threads (not visible in FIG. 3) that is configured for operational attachment to a conventional wireline or other connection adapter. However, it is to be observed that other types of connection members having different thread types or other connection means can be employed without departing from the scope of the present invention. By way of illustration, but not limitation, a pin-end threaded connection or other attachment means can be employed.

As depicted in FIG. 3, pressure sub 10 further comprises body section 13 defining outer surface 15. Central through bore 18 extends through said pressure sub 10. Lower connection threads 16 are disposed near the lower or distal end of body section 13; in the embodiment depicted in FIG. 3, said lower connection threads 16 comprise internal threads disposed on the inner surface of central through bore 18. At least one circumferential groove 19 extends around body section 13 and is configured to receive elastomeric sealing elements, such as O-rings 60. Further, radial extension ring 17 extends at least partially around the circumference of, and has a greater outer diameter than, said body section 13.

Central tension mandrel 70 comprises an elongate and substantially rigid member having a first end 78, second end 79 and body section 71 there between. In a preferred embodiment, said body section 71 has a substantially cylindrical shape defining outer surface 76. Lower threads 75 are disposed near second end 79; in the embodiment depicted in FIG. 3, said threads 75 comprise external threads. At least one circumferential step-down or change in outer diameter 76 extends around body section 71 near the lower or distal end of said central mandrel 70.

Central tension mandrel 70 further comprises connection member 72 disposed at or near first end 78 of said central tension mandrel 70. In a preferred embodiment, said connection member 72 has external male threads 73 configured to mate with internal threads 16 of pressure sub 10. Further, at least one elongate flow path 74 (such as a groove or channel) extends through said threads 73. In a preferred embodiment, said at least one flow path 74 comprises a channel oriented substantially parallel to the longitudinal axis of body section 71 and substantially perpendicular to the direction or orientation of said threads 73; however, it is to be observed that said at least flow path can have a different orientation without departing from the scope of the present invention, so long as it permits flow of fluid past said connection member 72. Internal plug 50 having an aperture 51 (not visible in FIG. 3) is operationally attached to connection member 72. Ball 29 is disposed within said internal plug 50 and is configured to selectively block said aperture 51 as more fully described herein.

Upper sleeve member 30 generally comprises a cylindrical member having a through bore 31 extending substantially along the longitudinal axis of said upper sleeve member 30. Similarly, lower sleeve member 40 comprises a cylindrical member having a through bore 41 extending substantially along the longitudinal axis of said lower sleeve member 40. At least one transverse side port 44 extends from said through bore 41 to the external surface of said lower sleeve member 40. Lower threads 42 are disposed at or near the lower or distal end of lower sleeve member 40.

Lower threads 32 are disposed at or near the lower or distal end of said upper sleeve member 30; in a preferred embodiment, said threads 32 are configured to engage with mating threads disposed on the inner surface of central through bore 41 of lower sleeve member 40 (not visible in FIG. 3). In a preferred embodiment, the central longitudinal axes of each of said pressure sub 10, upper sleeve member 30, lower sleeve member 40, central tension mandrel 70 and tension mandrel adapter 90 are all oriented substantially parallel to each other.

Cushion member 91 is received on tension mandrel 70. In a preferred embodiment, said cushion member 91 comprises a resilient or padded material (such as an elastomeric or foam material) configured to lessen or dampen force exerted between members contacting each other. Tension mandrel adapter member 90 is secured at second end 79 of tension mandrel 70 using lower threads 75.

Figure 4:
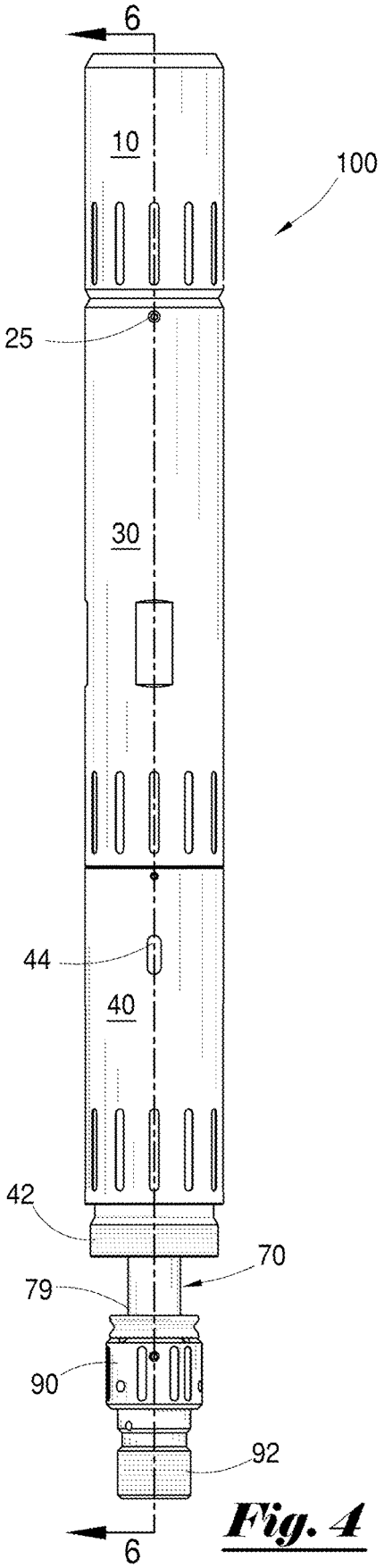
FIG. 4 depicts a side view of the setting tool apparatus of the present invention in a retracted or "un-stroked" configuration.

FIG. 4 depicts a side view of setting tool apparatus 100 of the present invention in a retracted or "un-stroked" configuration. As depicted in FIG. 4, said setting tool apparatus 100 generally comprises pressure sub 10, upper sleeve member 30, lower sleeve member 40, central tension mandrel 70 and tension mandrel adapter 90. Tension mandrel adapter member 90 is secured near the lower or distal end (second end 79) of tension mandrel 70. Lower sleeve member 40 is secured to upper sleeve member 30 which, in turn, is secured against movement along the length of central tension mandrel 70 using at least one shear screw (or pin) 25.

Figure 5:
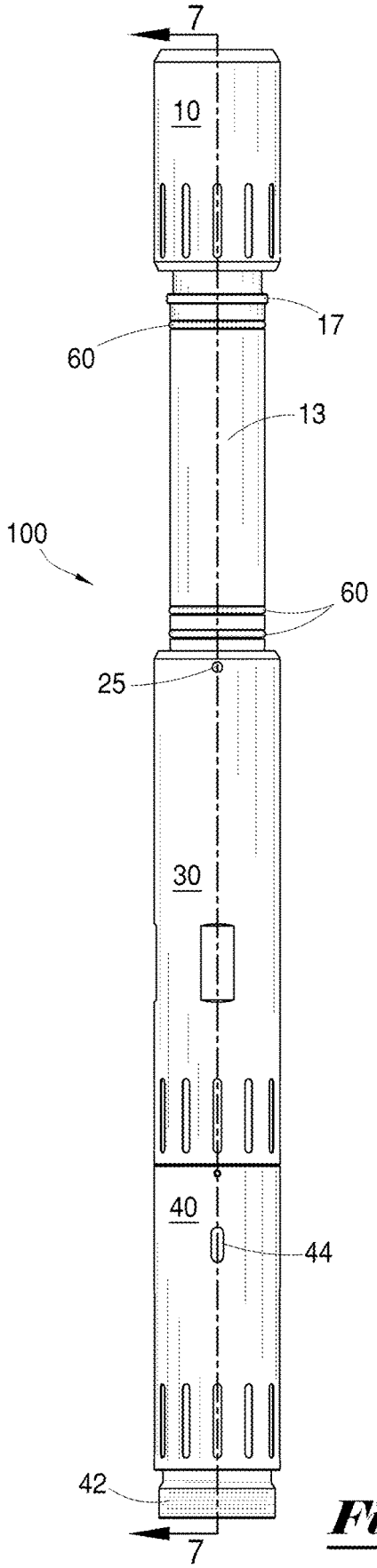
FIG. 5 depicts a side view of the setting tool apparatus of the present invention in an extended or "stroked" configuration.

FIG. 5 depicts a side view of setting tool apparatus 100 of the present invention in an extended or "stroked" configuration. As depicted in FIG. 5, at least one shear screw 25 is sheared or separated and, as such, is not constrained from axial movement by radial extension ring 17 that extends at least partially around the circumference of said body section 13. As a result, upper sleeve member 30 and attached lower sleeve member 40 are capable of movement along the longitudinal axis or length of central tension mandrel 70.

Still referring to FIG. 5, said upper sleeve member 30 and lower sleeve member 40 are displaced along the longitudinal axis of said tension mandrel 70, thereby exposing at least a portion of body section 13 of pressure sub 10. In this configuration, O-rings 60 disposed around said body section 13 are no longer positioned to engage against central bore 31 of upper sleeve member 30. Further, in the configuration depicted in FIG. 5, it is to be observed that lower threads 42 at the distal end of lower sleeve member 40 extend beyond tension mandrel adapter 90 (visible in FIG. 4 but not FIG. 5).

Figure 6A:
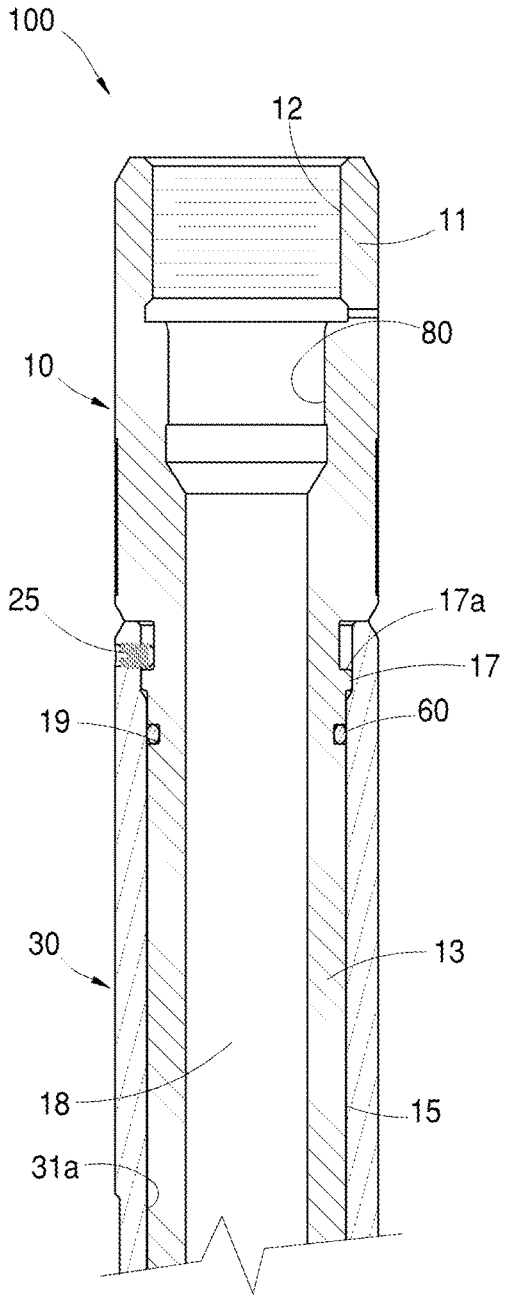
FIG. 6A depicts a side sectional view of a first portion of the setting tool apparatus of the present invention along line 6-6 of FIG. 4.
Figure 6B:
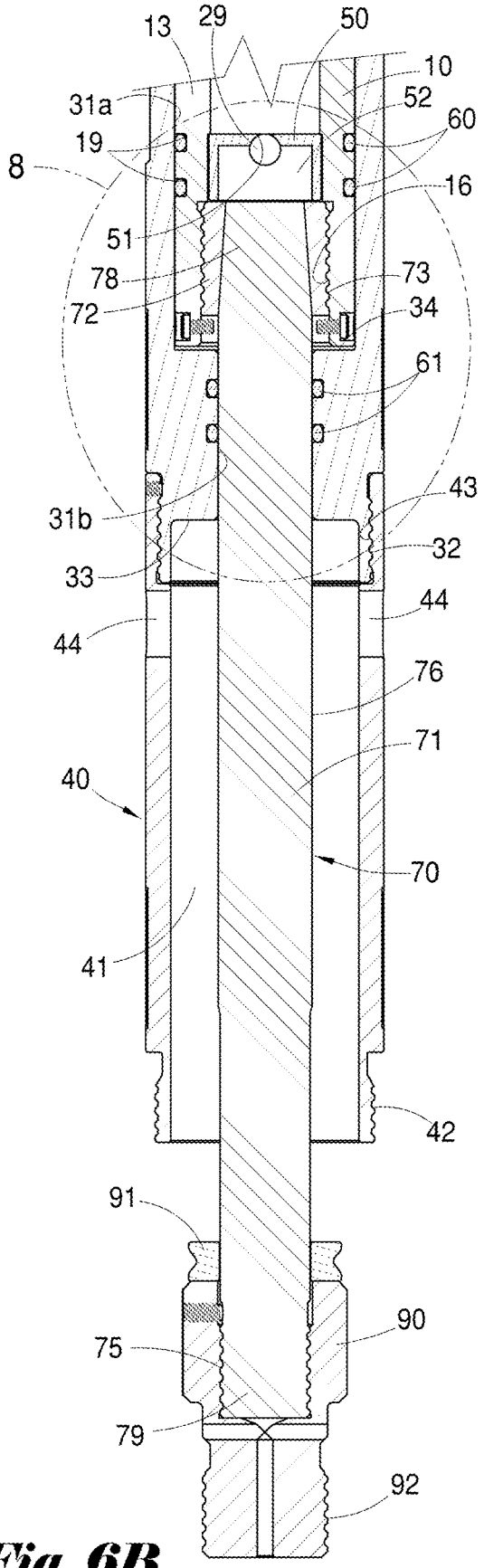
FIG. 6B depicts a side sectional view of a second portion of the setting tool apparatus of the present invention along line 6-6 of FIG. 4.

FIG. 6A depicts a side sectional view of a first (upper) portion of setting tool apparatus 100 of the present invention along line 6-6 of FIG. 4, while FIG. 6B depicts a side sectional view of a second (lower) portion of said setting tool apparatus 100 of the present invention along line 6-6 of FIG. 4. Setting tool apparatus 100 generally comprises pressure sub 10, upper sleeve member 30, lower sleeve member 40, central tension mandrel 70 and tension mandrel adapter 90.

Referring to FIG. 6A, pressure sub 10 generally comprises upper connection member 11 and body section 13. Central through bore 18 extends though said connection member 11 and body section 13; the upper portion of said central through bore 18 defines inner surface 80. In a preferred embodiment, said upper threaded connection member 11 comprises a female or "box-end" threaded connection having internal threads 12 that are configured for operational attachment to a conventional wireline or other connection adapter.

Still referring to FIG. 6A, pressure sub 10 further comprises body section 13 defining outer surface 15. Central through bore 18 extends through said pressure sub 10, while lower connection threads 16 are disposed near the lower or distal end of body section 13. Elastomeric sealing elements, such as O-rings 60, are disposed within circumferential grooves extending around body section 13; said O-rings 60 engage against inner surface 31*a* of central bore 31 of upper sleeve member 30 in order to form a fluid pressure seal.

Further, radial extension ring 17 extends at least partially around the outer circumferential surface of said body section 13. At least one shear screw 25 is disposed within a transverse bore extending through upper sleeve member 30 and engages against a shoulder surface 17*a* of radial extension ring 17; in this configuration, said at least one shear screw 25 prevents axial movement of upper sleeve member 30 (as well as any operationally attached components) along the longitudinal axis of central tension mandrel 70.

Central tension mandrel 70 comprises an elongate and substantially rigid member having a first end 78, second end 79 and body section 71 defining outer surface 76. Elastomeric sealing elements, such as O-rings 61, are disposed within circumferential grooves extending around body section 71; said O-rings 61 engage against outer surface 76 of central mandrel 70 in order to form a fluid pressure seal in the un-stroked position. In a preferred embodiment, central bore 31 has a smaller ID in the vicinity of O-rings 61 than near O-rings 60.

Central tension mandrel 70 further comprises connection member 72 disposed at or near first end 78 of said central tension mandrel 70. In a preferred embodiment, said connection member 72 has external male threads 73 configured to mate with internal threads 16 of pressure sub 10. Although not visible in FIG. 6B, at least one flow path 74 extends through said threads 73 and permits flow of fluid past connection member 72 as more fully described herein.

Internal plug or housing 50 having aperture 51 is operationally attached to connection member 72. Said internal plug 50 further defines an inner chamber or void 52. Ball 29 is moveably disposed within said inner chamber or void 52 of said internal plug 50, and is configured to selectively seat against said internal plug 50 in order to selectively block or obstruct said aperture 51.

Lower sleeve member 40 comprises a cylindrical member having a through bore 41 extending substantially along the longitudinal axis of said lower sleeve member 40. At least one transverse side port 44 extends from said through bore 41 to the external surface of said lower sleeve member 40, while threads 42 are disposed at or near the lower or distal end of lower sleeve member 40. Threads 32 of upper sleeve member 30 are configured to engage with mating threads 43 disposed on the inner surface of central through bore 41 of lower sleeve member 40. Cushion member 91 is received on tension mandrel 70. Tension mandrel adapter member 90 is secured at second end 79 of tension mandrel 70 using lower threads 75.

Figure 8:
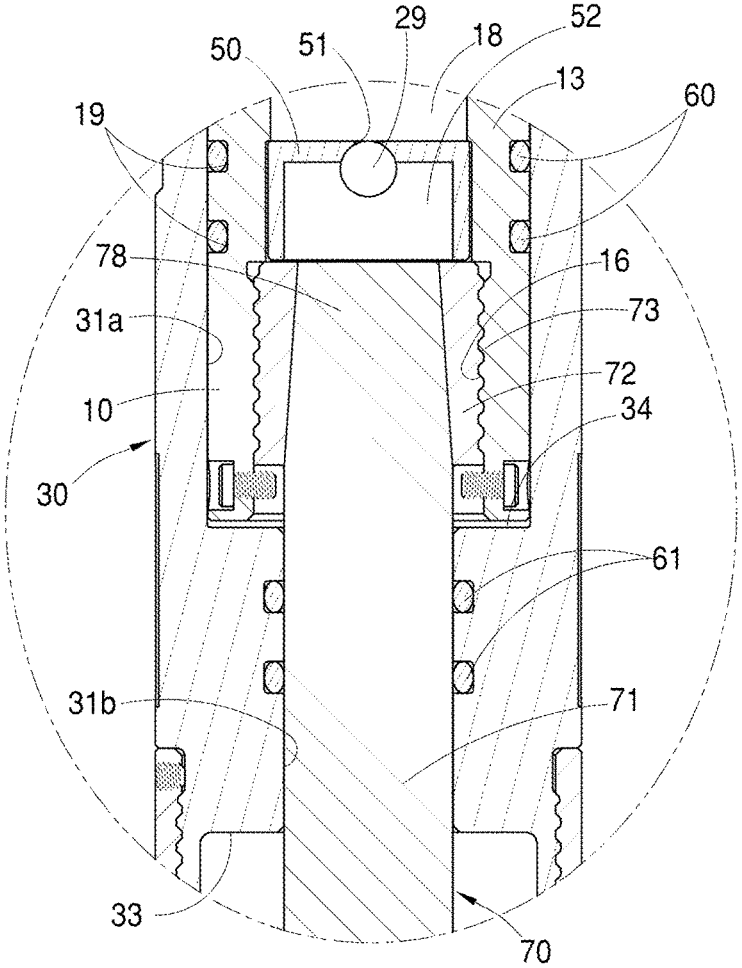
FIG. 8 depicts a detailed view of the highlighted area depicted in FIG. 6B.

FIG. 8 depicts a detailed view of the highlighted area depicted in FIG. 6B. Central bore 18 extends through said pressure sub 10, while lower connection threads 16 are disposed near the lower or distal end of body section 13. Elastomeric sealing elements (0-rings) 60 engage against inner surface 31*a* of central bore 31 of upper sleeve member 30 in order to form a fluid pressure seal. Similarly, elastomeric sealing elements (O-rings 61) extend around body section 71 of tension mandrel 70; said O-rings 61 engage against outer surface 76 of central mandrel 70 in order to form a fluid pressure seal in the un-stroked position.

Connection member 72 is disposed at or near first end 78 of said central tension mandrel 70. Although not visible in FIG. 8, at least one flow path 74 extends through said threads 73 of connection member 72 and permits flow of fluid past said connection member 72 as more fully described herein. Internal plug 50 having aperture 51 defines an inner chamber or void 52. Ball 29 is moveably disposed within said inner chamber or void 52 of said internal plug 50, and is configured to selectively seat against said internal plug 50 in order to selectively block or obstruct aperture 51.

Setting tool 100 of the present invention maintains a fluid pressure that is supplied or energized by pressurized gas. Said fluid pressure is converted into force or kinetic energy used to displace a portion of said setting tool 100 that, in turn, axially displaces outer shifting sleeve component of a separate wellbore device (not shown). Thus, setting tool 100 of the present invention may be used to axially displace or otherwise move, shift, or load a separate wellbore device (not shown), such as a fracturing ("frac") plug, packer, swage, bridge plug, or the like.

Referring to FIGS. 6A and 6B, a power charge is beneficially loaded into central bore 18 of pressure sub 10 which is configured to define a pressure chamber. Setting tool 100 can be operationally connected to a conventional bottom hole assembly of a wireline (such as, for example, a wireline bottom hole assembly that would be used with a "Baker 20" or other conventional setting tool), typically via upper threads 12 of pressure sub 10. Said setting tool 100 can also be connected at its distal end to a plug, packer or other tool to be set downhole within a wellbore using threads 92 of tension mandrel adapter 90 and threads 42 of lower sleeve 40. Thereafter, setting tool 100 of the present invention 10 and the attached device to be anchored within a wellbore are conveyed to a desired depth within said wellbore.

After the aforementioned assembly has been positioned at a desired setting depth within a wellbore, said power charge disposed within bore 18 (also sometimes referred to as a power charge chamber) is selectively ignited, typically by some actuation signal or other triggering action initiated at the surface and conveyed downhole to setting tool 100. As said charge burns, gas is generated and expands within said pressure chamber formed by bore 18. The design and manufacture of suitable power charges and their operation within setting tools of the type described herein is understood by those in the art and, for clarity and conciseness, is described further. It is to be observed that said power charges may be commercially available, or specifically designed and manufactured for use in connection with setting tool 100 of the present invention.

Figure 7A:
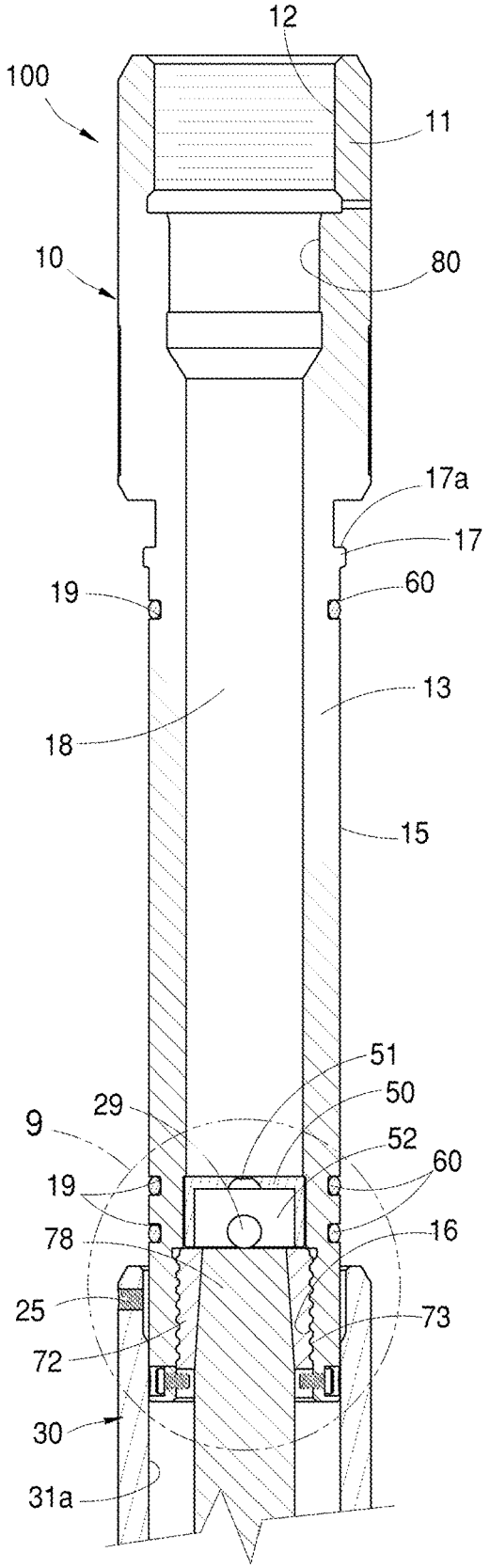
FIG. 7A depicts a side sectional view of a first portion of the setting tool apparatus of the present invention along line 7-7 of FIG. 5.
Figure 7B:
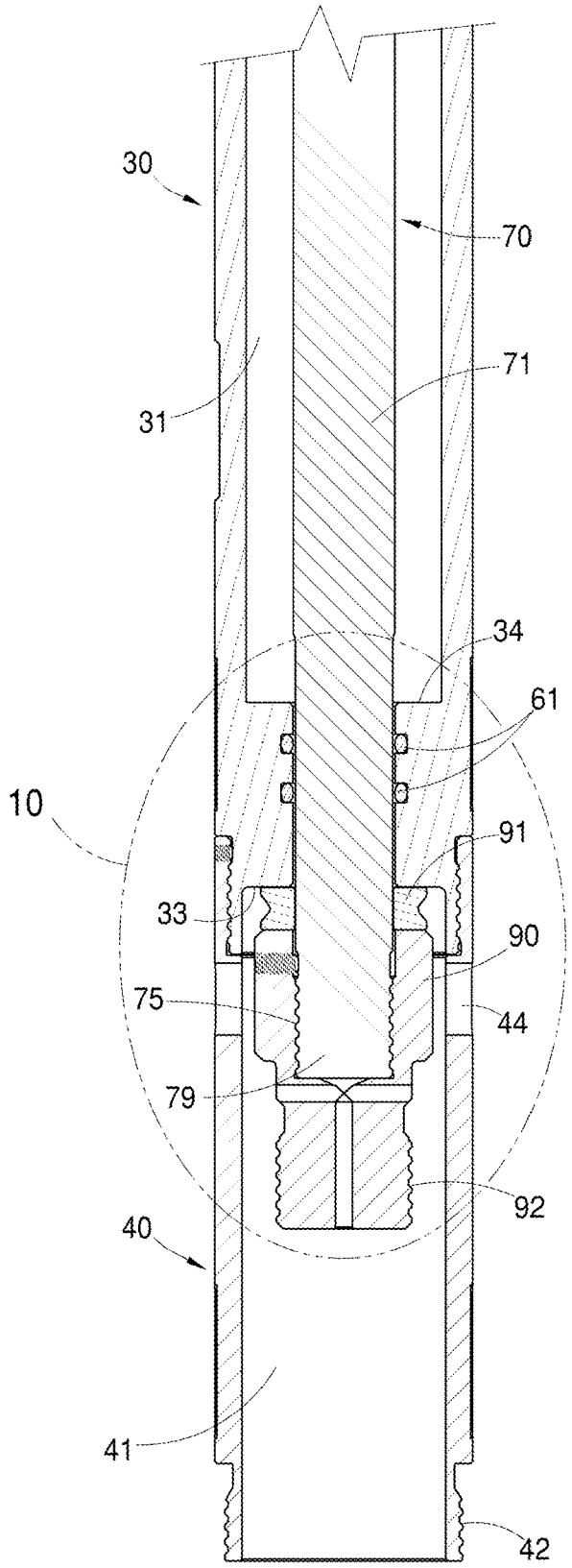
FIG. 7B depicts a side sectional view of a second portion of the setting tool apparatus of the present invention along line 7-7 of FIG. 5.
Figure 9:
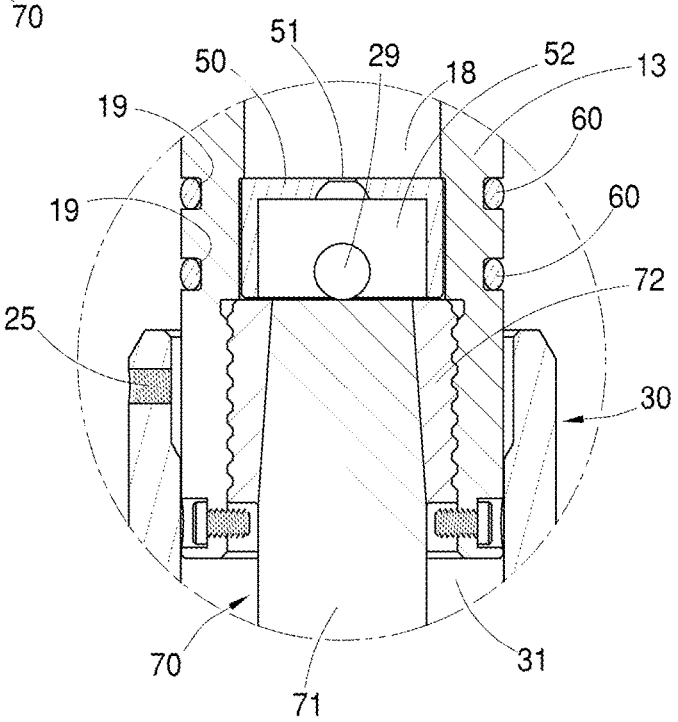
FIG. 9 depicts a detailed view of the highlighted area depicted in FIG. 7A.
Figure 10:
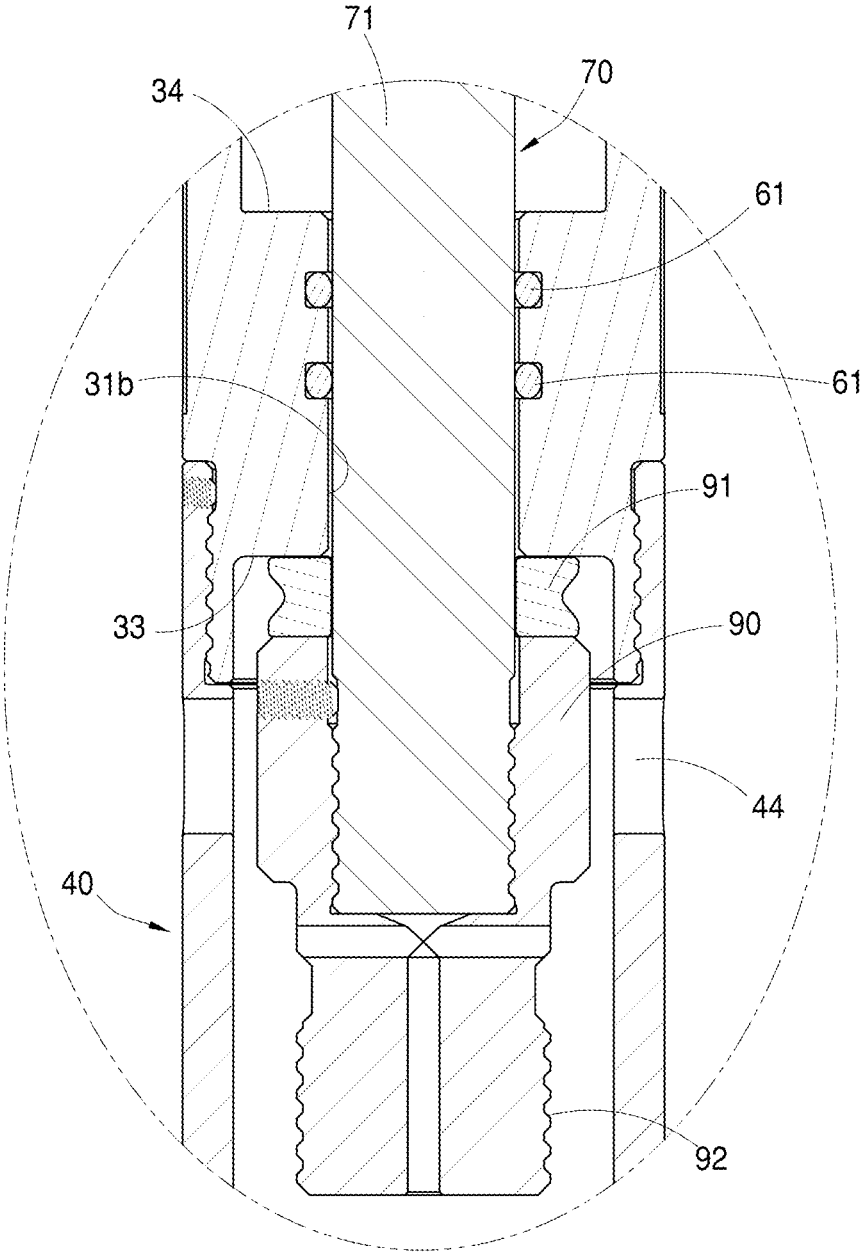
FIG. 10 depicts a detailed view of the highlighted area depicted in FIG. 7B.

FIG. 7A depicts a first (upper) portion of setting tool apparatus 100 of the present invention along line 7-7 of FIG. 5, while FIG. 7B depicts a second (lower) portion of said setting tool apparatus 100 of the present invention along line 7-7 of FIG. 5. FIG. 9 depicts a detailed view of the highlighted area depicted in FIG. 7A. In operation, setting tool 100 may be used to actuate and set a separate well tool (not shown) using a translating assembly well known to those in the art.

In a preferred embodiment, a force dampening assembly is beneficially disposed between said pressure chamber. Said force dampening assembly can comprise an internal plug 50 having a central aperture 51 and defining an inner space 52. Ball 29, as well as dampening media, is disposed within said inner space 52 formed by said internal plug 50. In the "running" or pre-stroke configuration, ball 29 is seated against and obstructs aperture 51.

Fluid pressure generated within said pressure chamber (bore 18) exerts force on ball 29, causing said ball 29 to become unseated from the seat formed by aperture 51 of internal plug 50. Said fluid (gas) pressure then forces dampening media disposed within inner chamber 52 of internal plug 50 through at least one flow path 74 (such as an elongate groove or flow channel) extending through threads 73 of connection member 72. (Said flow channels are not visible in FIGS. 7A and 7B, but can be seen in FIG. 3). Said flow path(s) 74 are designed to slow the expansion of gas in order to set the downhole tools more smoothly and evenly.

Unlike conventional setting tools which typically comprise some form of flow ports or holes in said pressure chamber (that can become easily clogged or plugged), in a preferred embodiment said optimized flow paths 74 may comprise grooves or channels. Said optimized flow areas permit fluid to flow past said connection member 72 and tension mandrel 70 in a controlled rate. Although other materials can be used without departing from the scope of the present invention, said dampening media can comprise a high viscosity material such as grease or other flowable fluid that has a desired resistance to flow.

After a predetermined volume of dampening media has passed through said optimized flow paths 74, said dampening media then applies pressure to the piston area defined by surface 34 of sleeve member 30. A first set of sealing members comprises elastomeric sealing elements (O-rings) 60 that engage against inner surface 31*a* of central bore 31 of upper sleeve member 30 in order to form a fluid pressure seal. A second set of sealing members comprises elastomeric sealing elements (O-rings 61) that extend around body section 71 of tension mandrel 70; in the un-stroked position (shown in FIGS. 6A and 6B), said O-rings 61 engage against outer surface 76 of central mandrel 70 in order to form a fluid pressure seal. However, it is to be observed that said O-rings 61 only engage and form said seal against the portion of tension mandrel 70 having the larger outer diameter, but not the (lower) portion of said mandrel 70 having the smaller outer diameter; hence no such fluid pressure seal is formed by O-rings 61 in the fully stroked configuration depicted in FIGS. 7A and 7B.

As the power charge gas further expands, the force generated by fluid pressure acting on piston surface 34 causes said at least one shear screw 25 to separate, thereby releasing the locking engagement of said shear screw 25 against shoulder 17*a* of radial extension 17 and allowing downward movement of upper sleeve member 30 and attached lower sleeve member 40. Such downward movement starts the setting process of the downhole tool by forcing the outer components downward while the inner components remain stationary.

After tension mandrel adapter 90 enters bore 41 of the lower pressure sleeve member 40, the fluid bypass area (that is, the flow path formed by the annular space between the outer surface of the mandrel adapter 90 and the inner surface of bore 41 of lower sleeve member 40 is greatly reduced which acts as a mechanism to further regulate the setting stroke. As the power charge burns completely, the setting tool will reach its maximum stroke length; at this point, the downhole tool is completely set and released from setting tool 100. Cushion 91 absorbs impact force between lower surface 33 of upper sleeve member 30 and tension mandrel adapter 90, preventing damage from repeated impacts from multiple setting iterations. Outer components (upper sleeve member 30 and lower sleeve member 40 are then free to stroke completely and reach a bleed off position.

After the stroke of setting tool 100 is complete, seals 60 reach the top of the upper pressure sleeve 30 which causes them to come off seat and allow the remaining gas pressure to bleed off. Also, seals 61 are permitted to reach the bottom of the tension mandrel 70; because the lower portion of said mandrel 70 has a smaller outer diameter than the upper portion of said mandrel 70, O-rings 61 no longer engage against said outer surface 76 of mandrel 70 (or form a fluid pressure seal) in said stroked portion. As a result, the fluid pressure seal formed by said O-rings 61 is released, thereby permitting any remaining fluid pressure to bleed off. Put another way, when setting tool 100 is in the fully stroked position, both sets of integral O-rings 60 and 61 are unseated, which guarantees bleed off of any internal pressure downhole. Furthermore, when setting tool 100 is in the fully stroked position, said O-rings 60 are all visible, thereby allowing users have positive visual confirmation that setting tool 100 has been fully stroked from a safe distance.

Setting tool 100 can then be retrieved from a wellbore and can be redressed to be run again. In a preferred embodiment, it is to be observed that the dampening assembly of the present invention (typically comprising internal plug 50, ball 29 and dampening media such as grease or other highly viscous fluid) can be separately removed from setting tool 100 of the present invention, and replaced as a separate modular and pre-loaded component to facilitate quick, efficient and cost effective redressing of setting tool 100.

Setting tool 100 of the present invention greatly reduces the chances of unintended or inadvertent pre-setting. Shear screw(s) 25 are sized so that pulling on setting tool 100 with wireline cannot stroke the tool. A conventional wireline rope socket is weaker than said shear screw 25 or the sum of said shear screws' shear value; if setting tool 100 becomes stuck within a wellbore, the rope socket (weak point) will separate before setting tool 100 will stroke.

Additionally, the piston area of setting tool 100 is designed so that said setting tool will flood with wellbore fluids in the event of a catastrophic O-ring leak. Any pressure downhole would be balanced across the piston area, meaning that wellbore pressure cannot inadvertently stroke setting tool 100 (unlike conventional setting tools which can inadvertently stroke and if wellbore pressure enters the tool above the pistons).

Top and bottom connections of setting tool 100 are designed to plug directly into industry standard wireline equipment (i.e. firing head and wireline adapter kits for plugs). The structure, attachment, and use of both the firing head and the setting adapter (which are commercially available) is understood by those in the art and, for clarity and conciseness, is not described in detail in this disclosure. Setting tool 100 is more rigid than conventional setting tools in order to make the setting tool of the present invention less susceptible to bending when running into deviated wellbores.

Windows or apertures 44 in the lower pressure sleeve 40 allow easy access to wireline adapter kit set screws when the setting tool 100 is in the stroked position, thereby expediting the teardown process. Ports in the tension mandrel adapter allow wellbore pressure to enter the orifice above a ball on seat which helps to keep the ball in place upon release from the frac plug. Conventional tools without this feature tend to "suck" the ball off seat when the tool releases.

Figure 11:
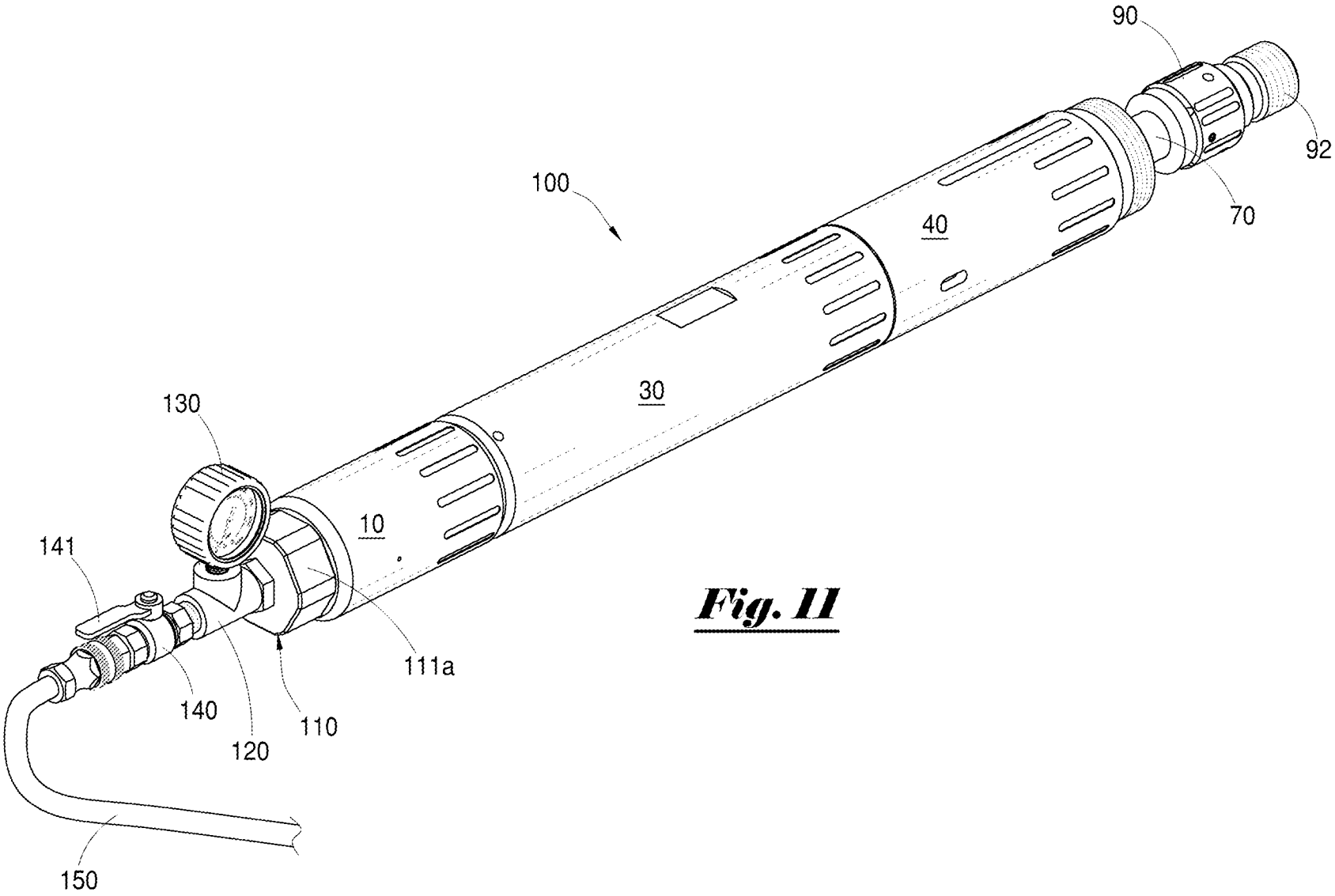
FIG. 11 depicts a side perspective view of a portion of the testing apparatus of the present invention configured for testing of a setting tool in accordance with the present invention.

FIG. 11 depicts a side perspective view of a portion of the testing apparatus of the present invention configured for testing of a downhole setting tool in accordance with the present invention. It is to be observed that said setting tool is depicted in FIG. 11 as setting tool apparatus 100 of the present invention; however, the testing method and apparatus of the present invention can be used in connection with any number of other setting tools or downhole assemblies.

As reflected in FIG. 11, setting tool 100 is depicted in a retracted or "un-stroked" configuration. Setting tool 100 generally comprises pressure sub 10, upper sleeve member 30, lower sleeve member 40, central tension mandrel 70 and tension mandrel adapter 90 having threads 92. In the configuration depicted in FIG. 11, lower sleeve member 40 is secured to upper sleeve member 30 which, in turn, is secured against movement along the length of central tension mandrel 70 using at least one shear screw or pin.

Still referring to FIG. 11, cap member 110 is secured to pressure sub 10, while fitting 120 is attached to cap member 110. Pressure gauge 130 and isolating fluid valve 140 are attached to said fitting 120. Although other embodiments can be envisioned without departing from the scope of the invention, in a preferred embodiment said isolating fluid valve 140 comprises a conventional ball valve having actuation handle 141 for selectively opening and closing said isolating fluid valve 140. Conduit 150, which can be a conventional hose or other tubing, is attached to isolating fluid valve 140.

Figure 12:
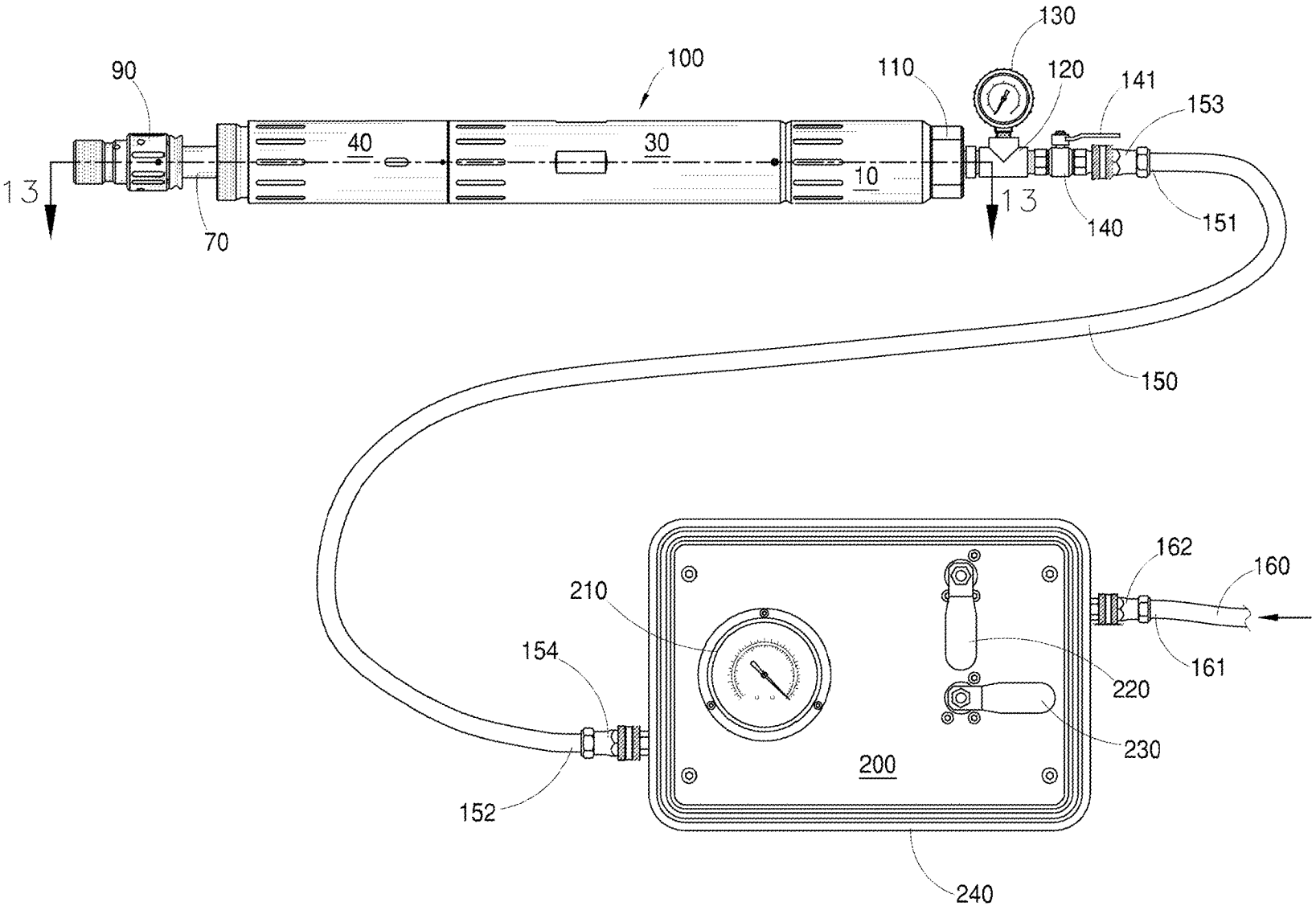
FIG. 12 depicts a side view of the testing apparatus of the present invention configured for testing of a setting tool.

FIG. 12 depicts a side view of setting tool 100 and testing apparatus of the present invention. Referring to FIG. 12, cap member 110 is secured to pressure sub 10. Fitting 120 is attached to cap member 110. Pressure gauge 130 and isolating fluid valve 140 (having actuation handle 141) are attached to said fitting 120. Conduit 150 has first end 151 and second end 152. In the embodiment depicted in FIG. 12, first end 151 is attached to first hose fitting 153 which, in turn, is operationally attached to isolating fluid valve 140. Second end 152 of conduit 150 is attached to second hose fitting 154 which, in turn, is operationally attached to test control kit 200. Second conduit 160, which can be a conventional hose or other tubing, has first end 161; said first end 161 of said second conduit 160 is attached to hose fitting 162 which, in turn, is operationally attached to test control kit 200.

Still referring to FIG. 12, in a preferred embodiment said test kit 200 further comprises pressure gauge 210, first control handle 220 and second control handle 230. Further, in a preferred embodiment, said test kit 200 is substantially contained within a hard-shell case 240 or other similar enclosure to protect the components of said test kit 200, especially during storage and transportation.

Figure 13A:
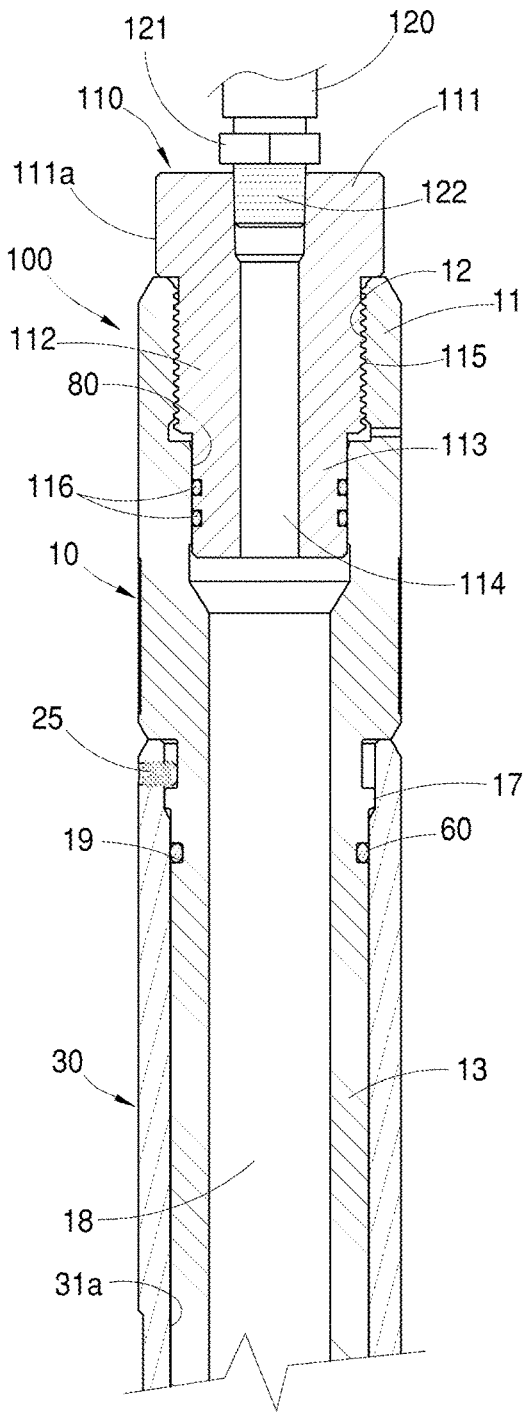
FIG. 13A depicts a sectional view of a first portion of a setting tool being tested in accordance with the present invention along line 13-13 of FIG. 12.
Figure 13B:
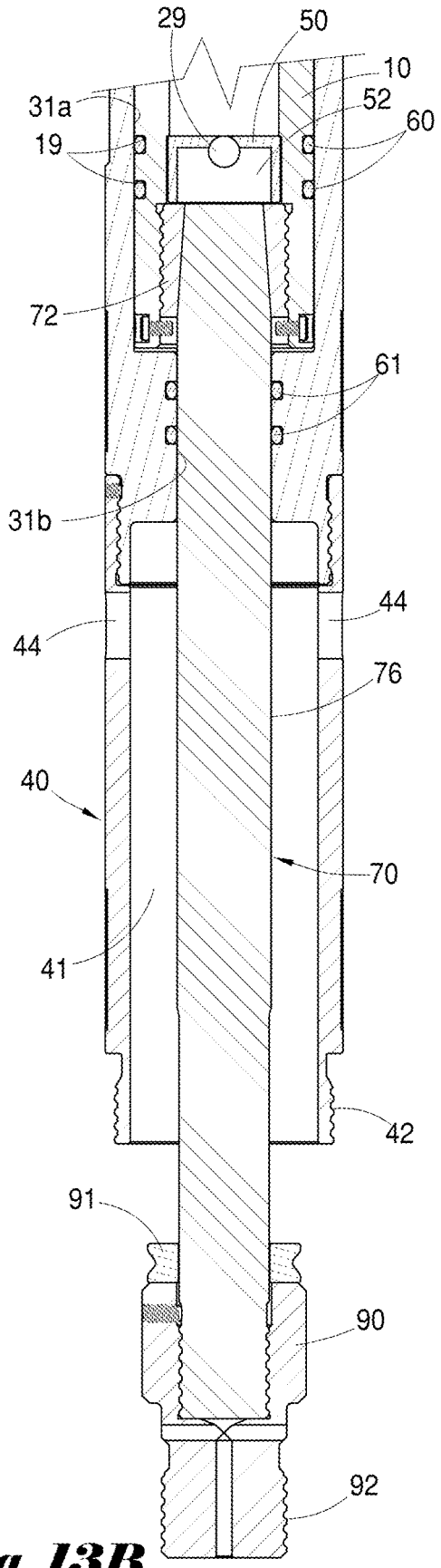
FIG. 13B depicts a sectional view of a second portion of a setting tool being tested in accordance with the present invention along line 13-13 of FIG. 12.

FIG. 13A depicts a side sectional view of a first portion of setting tool 100 along line 13-13 of FIG. 12 with cap member 110 of the test assembly of the present invention installed. FIG. 13B depicts a side sectional view of a second portion of said setting tool 100 of the present invention along line 13-13 of FIG. 12. Referring to FIG. 13A, pressure sub 10 generally comprises upper connection member 11 and body section 13. In a preferred embodiment, said upper threaded connection member 11 comprises a connection member. As depicted in the figures, said connection member 11 comprises a female or "box-end" threaded connection having internal threads 12; however, other connection members (such as male threaded connections and/or other connection means) can also be utilized. Central through bore 18 extends through said pressure sub 10 and defines inner surface 80 near the upper portion of said central through bore 18.

Still referring to FIG. 13A, cap member 110 is operationally attached to upper connection member 11 of pressure sub 10. In a preferred embodiment, said cap member 110 comprises upper section 111, central body section 112 and lower extension 113; said upper section 111, central body section 112 and lower extension 113 can beneficially each have different outer diameters. Central through bore 114 extends through said cap member 110. External threads 115 can be disposed on the outer surface of central body section 112, and are beneficially sized and configured to mate with internal threads 12 disposed on connection member 11. Notwithstanding the foregoing, other connection means besides threaded connections can be utilized without departing from the scope of the present invention. Elastomeric sealing elements, such as O-rings 116, are disposed within circumferential grooves extending around lower extension 113 of cap member 110; said O-rings 116 engage against inner surface 80 of central bore 18 in order to form a fluid pressure seal. Referring back to FIG. 11, it is to be observed that outer side surface of upper section 111 of cap member 110 can have a plurality of substantially flat sections 111*a* to facilitate gripping by a wrench or other instrument in order to apply torque forces to said cap member 110.

Fitting 120 is operationally attached to cap member 110. More specifically, fitting 120 has external threads 122. External threads 122 can be beneficially sized and configured to theadably mate with internal threads disposed within bore 114 of cap member 110. Notwithstanding the foregoing, other connection means besides threaded connections can be utilized without departing from the scope of the present invention. Fitting 120 can further comprise connection member 121 to facilitate gripping by a wrench or other instrument in order to apply torque forces to said fitting 120. Other reference numbers depicted in FIGS. 13A and 13B associated with setting tool 100 correspond to like reference numbers depicted in FIGS. 6A and 6B and discussed in detail above.

Figure 14:
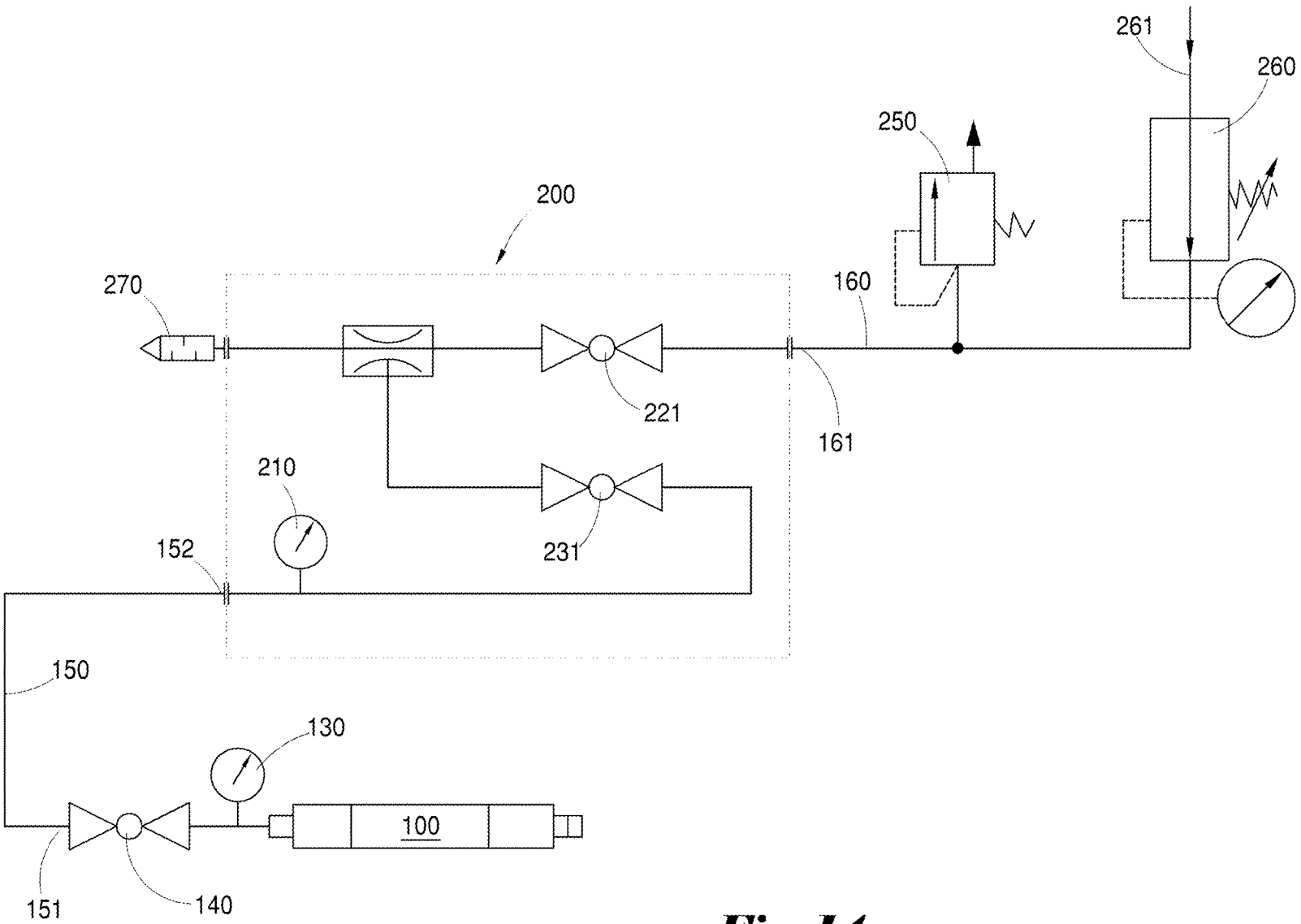
FIG. 14 depicts a schematic depiction of testing operations performed in accordance with the present invention.

FIG. 14 depicts a schematic depicting testing operations performed in accordance with the present invention. Pressure gauge 130 and fluid valve 140 are attached to said fitting 120 which, in turn, is operationally connected to setting tool 100. Conduit 150 has first end 151 and second end 152; first end 151 is operationally attached to isolating fluid valve 140 and second end 152 is operationally attached to test control kit 200. Second conduit 160 has first end 161 which is operationally attached to test control kit 200.

In a preferred embodiment, test kit 200 further comprises pressure gauge 210, first valve 221 (operationally attached to control handle 220, not pictured in FIG. 14) and second valve 231 (operationally attached to control handle 220, not pictured in FIG. 14). Test kit 200 further comprises vacuum or suction pump 250, fluid supply pump 260 and optional muffler 270. Fluid supply line or conduit 261 can be operationally attached, and provide fluid from an outside source, to fluid supply pump 260.

In operation, the testing assembly of the present invention can be used to test setting tool 100 of the present invention. Referring to FIG. 13A, in a preferred embodiment, grease or other lubricant can be installed within through bore 18 of pressure sub 10 including, without limitation, on all or part of inner surface 80 thereof. Thereafter, cap member 110 having fitting 120 (connected to conduit 150) is operationally attached to upper connection member 11 of pressure sub 10.

Referring to FIG. 14, vacuum or suction fluid pump 250 is actuated in order to pump air, as well as any other gasses or fluids present, from setting tool 100. More specifically, referring to FIG. 13A, fluid pump 250 is used to pump air and any other gases or fluids from inner bore 18 (and any voids or spaces in fluid communication therewith) of setting tool 100. In a preferred embodiment, a vacuum or suction pressure is applied until at least 25 mm Hg or other predetermined reading is observed on pressure gauges 130 and 210. It has been observed that a pressure reading of 25 mm Hg represents a useful measurement threshold within setting tool 100 for purposes of the present invention; however, a different pressure reading/threshold can be used for this purpose depending on operating conditions and/or other parameters without departing from the scope of the present invention.

By pumping air and/or other gasses or fluids out of inner bore 18 (and any voids or spaces in fluid communication therewith) of setting tool 100, a region of relatively lower pressure is created within inner bore 18 (and any such voids or spaces in fluid communication therewith) compared to surrounding atmospheric or other ambient pressure present around setting tool 100, together with any sealed voids within setting tool 100 that were sealed at said atmospheric or ambient pressure. Thereafter, isolating valve 140 can be closed in order to isolate and seal the volume of said region of relatively lower pressure within setting tool 100 (more specifically, inner bore 18 and any voids or spaces in fluid communication therewith) between isolating valve 140 and O-rings and other sealing elements that provide a fluid pressure seal between components of setting tool 100.

Additionally, although not required, conduit 150 can also be disconnected from valve 140.

It is to be observed that setting tool 100 comprises a number of O-rings and other sealing elements that are designed to provide a fluid pressure seal between components including, without limitation, between pressure sub 10 and upper sleeve member 30, as well as between upper sleeve member 40 and central tension mandrel 70. Said O-rings or other fluid pressure sealing elements include, without limitation, O-rings 60 and O-rings 61 depicted in FIGS. 13A and 13B. Generally, such O-rings or other sealing elements (including, without limitation, O-rings 60 and O-rings 61) must maintain a fluid pressure seal between said components in order for setting tool 100 to function properly. Any such leaking fluid pressure seals can compromise and undermine the operation of setting tool 100; hence, early identification of any such leaks prior to operational deployment of setting tool 100 can save time and expense, while also improving safety.

By establishing an isolated or "trapped" region of relatively lower pressure within inner bore 18 (and any voids or spaces in fluid communication therewith) compared to surrounding atmospheric or other ambient pressure present around setting tool 100, a pressure differential is created across said O-rings or other sealing elements (including, without limitation, O-rings 60 and O-rings 61). In the event that O-rings 60 and/or O-rings 61 lack pressure sealing integrity (that is, "leak"), fluid pressure will tend to equalize across said leaking O-ring(s), thereby causing measured pressure to increase within said isolated or "trapped" region of relatively lower pressure. As a result, any change or variation in measured pressure within isolated inner bore 18 (and voids or spaces in fluid communication therewith) greater than a certain predetermined amount or range, particularly if occurring within a certain predetermined time period for monitoring said measured pressure, provides positive indication of fluid communication across at least one of said O-rings or other sealing elements and, further, that at least one of said O-rings or other sealing elements lack sufficient pressure-sealing integrity or functionality.

Pressure gauge 130 and measured pressure can be monitored for a predetermined duration or period of time. In a preferred embodiment, said gauge 130 is monitored for a period of time between one (1) and five (5) minutes, and typically at least two (2) minutes; however, this monitoring period can be increased or decreased to fit particular operational considerations. Gauge readings can be recorded. In the event that said monitored measured pressure does not change more than a desired predetermined amount (which predetermined amount can be zero or no change), then setting tool 100 can be considered "passing" and can be used in service. On the other hand, in the event that such monitored measured pressure does change more than said predetermined amount, then said setting tool 100 can be deemed to have failed and can be removed from service, at least until such time that it can be repaired or reconditioned. Such repair or reconditioning can include, without limitation, removal and replacement of O-rings 60 and O-rings 61.

The testing assembly of the present invention is described herein primarily in connection with an air or pneumatically-powered vacuum or suction fluid pump 250 and other system components. However, it is to be observed that said vacuum or suction fluid pump 250 and/or other components can be operated using other power source(s)—such as, for example, electrical or hydraulic power—without departing from the scope of the present invention.

The present invention is described primarily in connection with creation of a "negative" pressure differential; that is, a pressure differential wherein fluid is pumped out of inner bore 18 of setting tool 100 (and any voids or spaces in fluid communication therewith) in order to create a region of relatively lower pressure than surrounding atmospheric or other ambient pressure present around setting tool 100. Notwithstanding the foregoing, it is to be observed that the present invention can also be practiced utilizing a "positive" pressure differential wherein fluid is pumped into inner bore 18 of setting tool 100 (and any voids or spaces in fluid communication therewith) in order to create a region of relatively "higher" pressure that is greater than surrounding atmospheric or other ambient pressure present around setting tool 100. However, this method of testing is not preferred because it requires the additional step of (temporarily) mechanically locking pressure sub 10 and/or central tension mandrel 70 relative to upper sleeve member 30 and/or lower sleeve member 40 in order to prevent inadvertent stroking of setting tool 100.

The method and apparatus of the present invention is a quality control/quality assurance system that provides a mobile testing assembly to confirm that a setting tool or other associated equipment was manufactured and assembled properly—and therefore fit for service—prior to running in a well bore. Said testing method and apparatus provides a gas (or other fluid) test of internal fluid pressure seals that serves to identify the presence of any undesired leaks in the internal seals. The mobile testing unit can be deployed in the field for testing on location, and can be quickly and efficiently customized with different fixtures to test an array of different equipment design.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for testing the sealing effectiveness of at least one internal fluid pressure sealing element of a wireline conveyed downhole setting tool comprising:

a) providing a wireline conveyed setting tool comprising:
   i) a pressure sub having an inner chamber;
   ii) a mandrel operationally attached to said pressure sub;
   iii) a setting sleeve slidably disposed on a said mandrel;
   iv) a dampening assembly disposed between said inner chamber and said setting sleeve for dampening force exerted on said setting sleeve, further comprising at least one elongate channel extending around said dampening assembly;
   v) at least one fluid pressure sealing element that forms a fluid pressure seal between said mandrel and said setting sleeve, wherein at least one internal space is defined between said mandrel and said setting sleeve;

b) connecting a conduit of a testing assembly to said wireline conveyed setting tool without connecting any other sleeve to said wireline conveyed setting tool;

c) pumping fluid from said at least one internal space through said at least one elongate channel around said dampening assembly, and through said inner chamber of said pressure sub, in order to reduce fluid pressure to a predetermined level within said at least one internal space;

d) creating a pressure differential across said at least one fluid pressure sealing element of said wireline conveyed setting tool;

e) measuring fluid pressure in said at least one internal space;

f) monitoring said measured fluid pressure for a predetermined period of time; and g) determining whether said measured fluid pressure remains within a predetermined acceptable variation range during said monitoring period.

2. The method of claim 1, further comprising repairing at least one fluid pressure seal of said wireline conveyed setting tool prior to running said wireline conveyed setting tool into a well if said measured fluid pressure exceeds said predetermined variation range during said monitoring period.

3. The method of claim 1, wherein said step of determining whether said measured fluid pressure remains within a predetermined variation range during said monitoring period is performed prior to transporting said wireline conveyed setting tool to a well site.

4. The method of claim 1, wherein said step of determining whether said measured fluid pressure remains within a predetermined variation range during said monitoring period is performed at a well site prior to installing said wireline conveyed setting tool in a well.

5. The method of claim 1, wherein said predetermined fluid pressure level within said at least one internal space is about 25 mm Hg.

6. The method of claim 1, wherein said predetermined period of time is between one and five minutes.

7. The method of claim 1, wherein said predetermined acceptable variation range is 0 mm Hg.

8. A method for testing the sealing effectiveness of at least one internal fluid pressure sealing element of a wireline conveyed downhole setting tool comprising:

a) providing a test kit comprising:

i) at least one fluid pump;

ii) at least one fluid conduit operationally attached to said pump;

iii) at least one isolation valve;

iv) at least one pressure gauge;

b) connecting said at least one fluid conduit to said wireline conveyed setting tool, without connecting any other sleeve to said wireline conveyed setting tool, wherein said wireline conveyed setting tool comprises:

i) a pressure sub having an inner chamber;

ii) a mandrel operationally attached to said pressure sub;

iii) a setting sleeve slidably disposed on a said mandrel;

iv) a dampening assembly disposed between said inner chamber and said setting sleeve for dampening force exerted on said setting sleeve, further comprising at least one elongate channel extending around said dampening assembly; and v) at least one fluid pressure sealing element forming a fluid pressure seal between said mandrel and said setting sleeve, wherein at least one internal space is defined between said mandrel and said setting sleeve;

c) pumping fluid through said at least one elongate channel around said dampening assembly and said inner chamber of said pressure sub in order to reduce fluid pressure to a predetermined level within said at least one internal space;

d) creating a pressure differential across at least one fluid pressure sealing element of said wireline conveyed setting tool;

e) isolating the volume of said at least one internal space;

f) measuring fluid pressure in said at least one internal space;

g) monitoring said measured fluid pressure for a predetermined period of time; and h) determining whether said measured fluid pressure remains within a predetermined variation range during said monitoring period.

9. The method of claim 8, further comprising repairing at least one fluid pressure seal of said wireline conveyed setting tool prior to running said wireline conveyed setting tool into a well if said measured fluid pressure exceeds said predetermined variation range during said monitoring period.

10. The method of claim 8, wherein said step of determining whether said measured fluid pressure remains within a predetermined variation range during said monitoring period is performed prior to transporting said wireline conveyed setting tool to a well site.

11. The method of claim 8, wherein said step of determining whether said measured fluid pressure remains within a predetermined variation range during said monitoring period is performed at a well site prior to installing said wireline conveyed setting tool in a well.

12. The method of claim 8, wherein said predetermined fluid pressure level within said at least one internal space is about 25 mm Hg.

13. The method of claim 8, wherein said predetermined period of time is between one and five minutes.

14. The method of claim 8, wherein said predetermined acceptable variation range is 0 mm Hg.

15. A method for testing the sealing effectiveness of at least one internal fluid pressure sealing element of a wireline conveyed downhole setting tool comprising:

a) providing a test kit comprising:

i) at least one fluid pump;

ii) at least one fluid conduit operationally attached to said pump;

iii) at least one isolation valve;

iv) at least one pressure gauge;

b) connecting said at least one fluid conduit to said wireline conveyed setting tool, without connecting any other sleeve to said wireline conveyed setting tool, wherein said wireline conveyed setting tool comprises:

i) a pressure sub having an inner chamber;

ii) a mandrel operationally attached to said pressure sub;

iii) a setting sleeve having a bore, slidably disposed on a said mandrel;

iv) a dampening assembly disposed between said inner chamber and said setting sleeve for dampening force exerted on said setting sleeve, further comprising at least one elongate channel extending around said dampening assembly; and v) at least one fluid pressure sealing element forming a fluid pressure seal between said mandrel and said setting sleeve, and wherein at least one internal space is defined between said mandrel and said setting sleeve;

c) pumping fluid through said at least one elongate channel around said dampening assembly and said inner chamber of said pressure sub in order to reduce fluid pressure to a predetermined level within said at least one internal space;

d) creating a pressure differential across at least one fluid pressure sealing element of said wireline conveyed setting tool;

e) closing said at least one isolation valve to isolate the volume of said at least one internal space;

f) measuring fluid pressure in said isolated at least one internal space;

g) monitoring said measured fluid pressure for a predetermined period of time; and h) determining whether said measured fluid pressure remains within a predetermined variation range during said monitoring period.

16. The method of claim 15, further comprising repairing at least one fluid pressure seal of said wireline conveyed setting tool prior to running said wireline conveyed setting tool into a well if said measured fluid pressure exceeds said predetermined variation range during said monitoring period.

17. The method of claim 15, wherein said step of determining whether said measured fluid pressure remains within a predetermined variation range during said monitoring period is performed prior to transporting said wireline conveyed setting tool to a well site.

18. The method of claim 15, wherein said step of determining whether said measured fluid pressure remains within a predetermined variation range during said monitoring period is performed at a well site prior to installing said wireline conveyed setting tool in a well.

19. The method of claim 15, wherein said predetermined period of time is between one and five minutes.

20. The method of claim 15, wherein said predetermined acceptable variation range is 0 mm Hg.

* * * * *